US010890187B2

(12) United States Patent
Fukuhara et al.

(10) Patent No.: US 10,890,187 B2
(45) Date of Patent: Jan. 12, 2021

(54) SCROLL COMPRESSOR WITHA LUBRICANT SUPPLY SYSTEM AND REFRIGERATION CYCLE APPARATUS HAVING THE SCROLL COMPRESSOR

(71) Applicant: Mitsubishi Electric Corporation, Tokyo (JP)

(72) Inventors: Koichi Fukuhara, Tokyo (JP); Tomokazu Matsui, Tokyo (JP); Kohei Tatsuwaki, Tokyo (JP); Yuji Takamura, Tokyo (JP); Fumihiko Ishizono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 209 days.

(21) Appl. No.: 16/071,651

(22) PCT Filed: Mar. 31, 2016

(86) PCT No.: PCT/JP2016/060629
§ 371 (c)(1),
(2) Date: Jul. 20, 2018

(87) PCT Pub. No.: WO2017/168672
PCT Pub. Date: Oct. 5, 2017

(65) Prior Publication Data

US 2019/0032665 A1 Jan. 31, 2019

(51) Int. Cl.
*F04C 29/02* (2006.01)
*F04C 18/02* (2006.01)
*F04C 23/00* (2006.01)

(52) U.S. Cl.
CPC ..... *F04C 29/023* (2013.01); *F04C 18/02* (2013.01); *F04C 18/0215* (2013.01);
(Continued)

(58) Field of Classification Search
CPC .. F04C 18/02; F04C 18/0215; F04C 18/0253; F04C 23/008; F04C 29/023;
(Continued)

(56) References Cited

U.S. PATENT DOCUMENTS 5,176,506 A * 1/1993 Siebel ..... F04B 39/0261 184/6.16
6,071,100 A * 6/2000 Yamada ..... F01C 17/066 418/55.3
(Continued)

FOREIGN PATENT DOCUMENTS

JP H01-106995 A 4/1989
JP 2003-176793 A 6/2003
(Continued)

OTHER PUBLICATIONS

Extended European Search Report dated Nov. 30, 2018 issued in corresponding EP patent application No. 16896890.7.
(Continued)

*Primary Examiner* — Patrick Hamo
*Assistant Examiner* — Paul W Thiede
(74) *Attorney, Agent, or Firm* — Posz Law Group, PLC

(57) ABSTRACT

A scroll compressor includes a crank shaft 6, an orbiting scroll 32, and a second plug part 329. The crank shaft 6 has a lubricant channel 63 which allows lubricant 9 to flow therethrough. The orbiting scroll 32 is attached to the crank shaft 6 and has a second inner channel 327 that allows the lubricant supplied thereto through the crank shaft 6 to outwardly flow therethrough. The second plug part 329 serving as an adjustment part is provided in the second inner channel 327 of the orbiting scroll 32 and adjusts a flow amount of the lubricant 9 flowing through the second inner channel 327.

12 Claims, 7 Drawing Sheets

(52) U.S. Cl.
CPC ..... *F04C 18/0253* (2013.01); *F04C 23/008* (2013.01); *F04C 29/025* (2013.01); *F04C 29/028* (2013.01); *F05B 2210/30* (2013.01); *F05B 2210/40* (2013.01); *F05B 2240/60* (2013.01); *F05B 2260/98* (2013.01)

(58) Field of Classification Search
CPC .. F04C 29/025; F04C 29/028; F05B 2210/30; F05B 2210/40; F05B 2240/60; F05B 2260/98
USPC ... 418/55.1, 55.2, 55.3, 55.4, 55.5, 55.6, 88, 418/97, 150, 182; 417/410.1; 428/403
See application file for complete search history.

(56) References Cited

U.S. PATENT DOCUMENTS

| | | | | |
|---|---|---|---|---|
| 7,442,018 | B2 * | 10/2008 | Kiyokawa | F04C 14/06 184/6.16 |
| 8,827,667 | B2 * | 9/2014 | Iitsuka | F04C 23/008 418/55.1 |
| 2007/0065307 | A1 * | 3/2007 | Sugimoto | F04C 23/008 417/410.5 |
| 2007/0178002 | A1 | 8/2007 | Hiwata et al. | |
| 2013/0189080 | A1 | 7/2013 | Nakai et al. | |
| 2015/0030487 | A1 * | 1/2015 | Toyama | F04C 18/02 418/55.1 |
| 2015/0204599 | A1 * | 7/2015 | Chisaki | F24F 1/56 62/426 |
| 2019/0195224 | A1 * | 6/2019 | Matsui | F04C 23/008 |

FOREIGN PATENT DOCUMENTS

| | | | |
|---|---|---|---|
| JP | 2003-286976 | A | 10/2003 |
| JP | 2010-101188 | A | 5/2010 |
| JP | 2014-169677 | A | 9/2014 |
| JP | 2015-071950 | A | 4/2015 |
| WO | 2012/042825 | A1 | 4/2012 |

OTHER PUBLICATIONS

Office Action dated May 7, 2019 issued in corresponding JP patent application No. 2018-508268 (and English translation).
International Search Report ("ISR") dated Jul. 5, 2016 issued in corresponding International patent application No. PCT/JP2016/060629 (with English translation).

* cited by examiner

SCROLL COMPRESSOR WITHA LUBRICANT SUPPLY SYSTEM AND REFRIGERATION CYCLE APPARATUS HAVING THE SCROLL COMPRESSOR

TECHNICAL FIELD

The present invention relates to a scroll compressor and a lubricant supplying structure therein.

BACKGROUND ART

In a scroll compressor, an orbiting scroll orbits relative to a fixed scroll, thereby compressing refrigerant in a compression space formed by scroll laps of the orbiting scroll and the fixed scroll. This orbiting scroll is accommodated in a frame. A thrust load produced during orbiting of the orbiting scroll is supported by a thrust bearing provided in the frame. During the orbiting of the orbiting scroll, the orbiting scroll slides against the thrust bearing of the frame. Thus, it is required that lubricant be supplied to the thrust bearing to prevent seizure or the like. A variety of methods have been proposed as a method of supplying lubricant to the thrust bearing.

For example, there is a structure with which lubricant sucked up by a crank shaft is stored in a space between a frame and an orbiting scroll, and the lubricant is caused to overflow to be supplied to a thrust bearing (for example, see Patent Literature 1).

CITATION LIST

Patent Literature

Patent Literature 1: Japanese Unexamined Patent Application Publication No. 2014-169677

SUMMARY OF INVENTION

Technical Problem

Nowadays, there exist needs for application in which an operating frequency, that is, the rotation speed of the crank shaft is varied to vary output of the compressor. The lubricant is stored in a bottom part of a shell and transported to the orbiting scroll by the crank shaft. Since the amount of movement of the lubricant is proportional to the rotation speed of the crank shaft, the amount of the lubricant to be transported varies between low-speed operation and high-speed operation of the compressor.

With an overflow method as in Patent Literature 1, when the compressor is set to sufficiently supply the lubricant to the thrust bearing for low-speed operation, the lubricant supplied to a portion where scroll laps of the fixed scroll and the orbiting scroll slide against each other, that is, so-called lubricant lift is excessive during high-speed operation. This may increase the lubricant flowing to a heat exchanger and cause the lubricant to be stored in the heat exchanger, thereby reducing heat exchange efficiency.

In contrast, when the compressor is set such that the amount of lubricant lift becomes appropriate for high-speed operation, the lubricant supplied to the thrust bearing becomes insufficient during low-speed operation. This may cause seizure of the thrust bearing. Furthermore, sliding properties of the sides of scroll bodies of the fixed scroll and the orbiting scroll that form a compression chamber and sealing properties at distal ends of the scroll bodies may be degraded.

The present invention has been made to address the above-described problem. An object of the present invention is to provide a scroll compressor and a refrigeration cycle apparatus in which sufficient lubricant can be supplied even when an operating frequency is varied.

Solution to Problem

A scroll compressor of one embodiment of the present invention includes a crank shaft, an orbiting scroll, and an adjustment part. The crank shaft has a lubricant channel that allows lubricant to flow therethrough. The orbiting scroll is attached to the crank shaft and has at least one inner channel which allows the lubricant supplied thereto through the crank shaft to outwardly flow therethrough. The adjustment part is provided in the at least one inner channel of the orbiting scroll and adjusts a flow amount of the lubricant flowing through the at least one inner channel.

Advantageous Effects of Invention

According to the one embodiment of the present invention, the scroll compressor and the refrigeration cycle apparatus can be provided in which sufficient lubricant can be supplied even when the operating frequency is varied.

DESCRIPTION OF EMBODIMENTS

Figure 1:
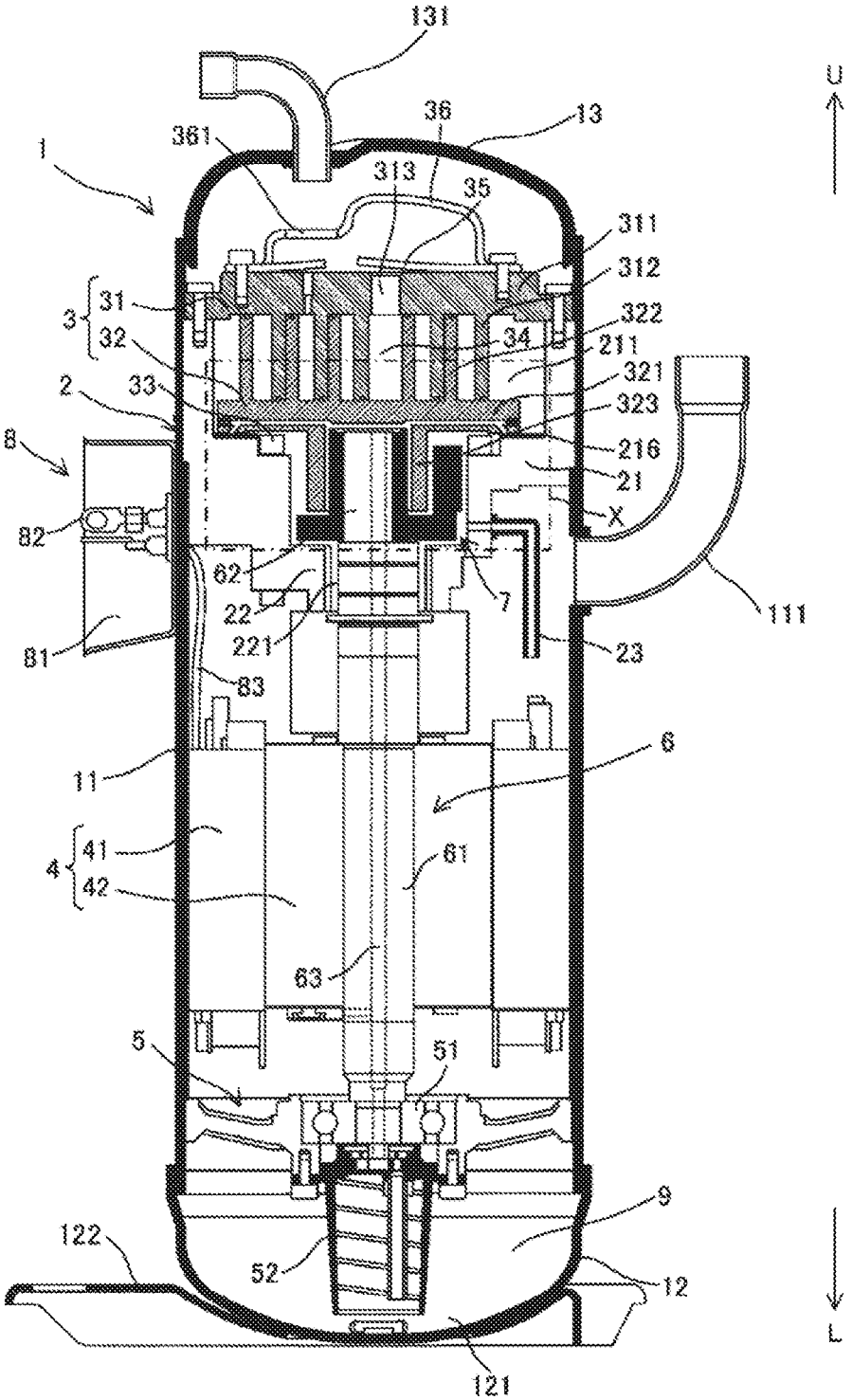
FIG. 1 is a schematic longitudinal sectional view of a scroll compressor according to Embodiment 1 of the present invention.

Embodiment of the present invention will be described below with reference to the drawings. In the drawings, the same or equivalent parts are denoted by the same reference signs, thereby description thereof is appropriately omitted or simplified. Furthermore, the shapes, sizes, arrangements, and so forth of structures illustrated in the drawings can be appropriately changed within the scope of the present invention.

Embodiment 1

Figure 2:
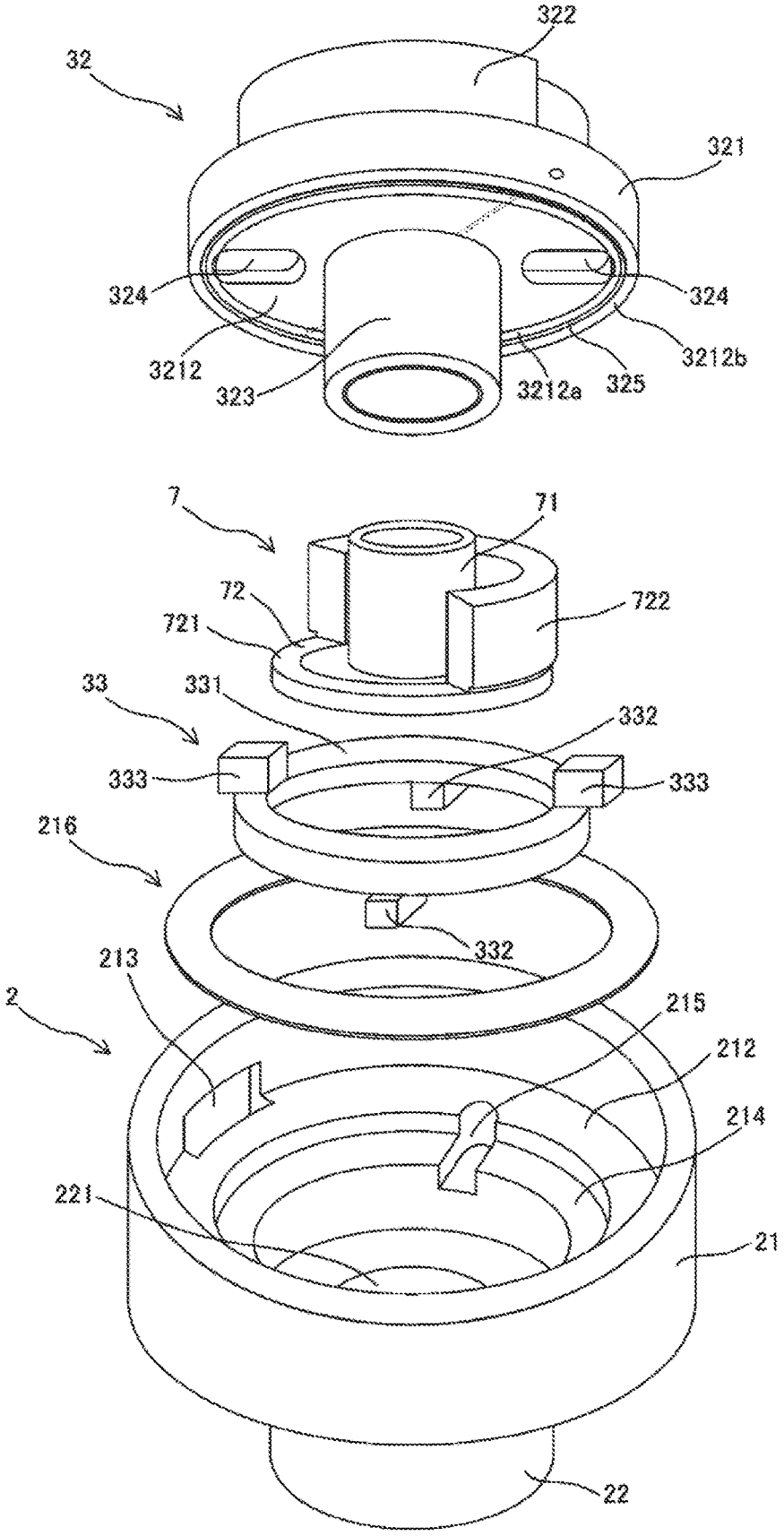
FIG. 2 is an exploded perspective view of a main frame, an orbiting scroll, and so forth of the scroll compressor according to Embodiment 1 of the present invention.

Embodiment 1 is described below. FIG. 1 is a schematic longitudinal sectional view of a scroll compressor according to Embodiment 1. FIG. 2 is an exploded perspective view of a main frame, an orbiting scroll, and so forth of the scroll compressor according to Embodiment 1 of the present invention. The compressor illustrated in FIG. 1 is a so-called vertical scroll compressor to be used with the central axis of a crank shaft, which will be described later, being substantially vertical to the ground. Regarding the directions, the upper portion is referred to as one end portion U, and the lower portion (portion close to the ground) is referred to as an other end portion L for description.

The scroll compressor includes a shell 1, a main frame 2, a compression mechanism unit 3, a drive mechanism unit 4, a sub-frame 5, a crank shaft 6, a bushing 7, and a power feed unit 8.

The shell 1 formed of an electrically conductive material such as metal is a cylindrical housing both ends of which are closed. The shell 1 includes a main shell 11, a lower shell 12, and an upper shell 13. The main shell 11 has a cylindrical shape and includes a suction pipe 111 at a side wall thereof. The suction pipe 111 is for introducing refrigerant into the shell 1 and communicates with the inside of the main shell 11. The lower shell 12 is a substantially semispherical bottom body. Part of a side wall of the lower shell 12 is connected to the lower end part of the main shell 11 by, for example, welding. Thus, an opening at the lower portion of the main shell 11 is closed. At least part of the inside of the lower shell 12 is used as a lubricant storage 121 in which lubricant 9 is stored. The upper shell 13 is a substantially semispherical lid body. Part of a side wall of the upper shell 13 is connected to the upper end part of the main shell 11 by, for example, welding. Thus, an opening at the upper portion of the main shell 11 is closed. The upper shell 13 includes a discharge pipe 131 at an upper part thereof. The discharge pipe 131 is for discharge of the refrigerant from the shell 1 and communicates with an inner space of the main shell 11. The shell 1 is supported by a fixing base 122 having a plurality of threaded holes. The scroll compressor can be fixed to another part such as a housing of an outdoor unit by screwing screws into these threaded holes.

The main frame 2 is a hollow metal supporting part and has an opening at a portion thereof close to the one end portion U. The main frame 2 is disposed in the shell 1. The main frame 2 includes a main body part 21, a main bearing part 22, and a lubricant return pipe 23. The main body part 21 is fixedly supported on an inner circumferential surface of a portion of the main shell 11 close to the one end portion U by shrinkage fitting, welding, or the like. An accommodating space 211 is formed in the main body part 21 along the longitudinal direction of the shell 1. The accommodating space 211 is open at a portion thereof close to the one end portion U and has a stepped shape in which the inner space reduces stepwise toward the other end portion L. As illustrated in FIG. 2, some surfaces of the stepped portion facing the one end portion U are included in a thrust surface 212 having a ring shape. The main frame 2 has refrigerant channels 213. Each of the refrigerant channels 213 is disposed in part of an outer circumferential portion of the thrust surface 212 and an inner wall surface of the main frame 2 continuous with the part of the thrust surface 212. The refrigerant channels 213 are holes through which the inside and the outside of the main frame 2 are spatially communicated with each other. A pair of the refrigerant channels 213 are provided so as to be arranged on a substantially straight line with the axis of the crank shaft 6 (for example, the central axis of a main shaft part 61, which will be described later) interposed therebetween.

Furthermore, an Oldham disposing part 214 is formed at part of the step portion of the main frame 2 closer the other end portion L than the thrust surface 212. The Oldham disposing part 214 has first Oldham grooves 215. The outer end portion of each of the first Oldham grooves 215 extends to part of the inner circumferential portion of the thrust surface 212. A pair of the first Oldham grooves 215 are provided so as to be arranged on a substantially straight line with the axis of the crank shaft 6 interposed therebetween. A thrust plate 216 formed of a steel-based material is disposed on the thrust surface 212. The thrust plate 216 has a ring-shape and is disposed on the thrust surface 212, thereby covering part of each of the refrigerant channels 213 and part of each of the first Oldham grooves 215. Thus, the thrust plate 216 functions as a thrust bearing according to Embodiment 1. The main bearing part 22 is formed at a portion closer to the other end portion L than the main body part 21 and continuous with the main body part 21. The main bearing part 22 has a shaft hole 221 therein. The shaft hole 221 vertically penetrates through the main bearing part 22. A portion of the shaft hole 221 close to the one end portion U communicates with the accommodating space 211. The lubricant 9 stored in the accommodating space 211 is returned to the lubricant storage 121 of the lower shell 12 through the lubricant return pipe 23. The lubricant return pipe 23 is connected to a lubricant discharge hole 218 formed in a wall part 217 facing a weight part 722 of the bushing 7, which will be described later.

The lubricant 9 is a refrigerating machine oil containing, for example, an este based synthetic oil. The lubricant 9 is stored in the lubricant storage 121 of the lower shell 12. The lubricant 9, through a lubricant channel 63 of the crank shaft 6, reduces wear of parts in mechanical contact with one another, adjusts the temperatures of sliding portions, and improves sealing properties. Preferably, the lubricant 9 has, for example, good lubricating characteristics, good electrical insulating properties, high stability, high dissolubility in the refrigerant, and high fluidity at low-temperature. It is also preferable that the lubricant 9 has an appropriate viscosity.

The compression mechanism unit 3 compresses the refrigerant. According to Embodiment 1, the compression mechanism unit 3 is a scroll compression mechanism that includes a fixed scroll 31 and an orbiting scroll 32. The fixed scroll 31 is formed of metal such as aluminum or cast iron and includes a first base plate 311 and a first scroll body 312. The first base plate 311 has a discoidal shape. An outer end part of the first base plate 311 is in contact with the main body part 21 and fixed to the main frame 2 with screws or the like. The first scroll body 312 projects from a surface of the first base plate 311 close to the other end portion L to form a scroll-shaped wall. A distal end of the first scroll body 312 faces the other end portion L. The orbiting scroll 32 is formed of metal such as aluminum or cast iron and includes a second base plate 321, a second scroll body 322, a cylindrical part 323, and second Oldham grooves 324. The second base plate 321 has a discoidal shape. The second base plate 321 is supported (borne) by the main frame 2 such that at least part of an outer circumferential region of an other-end surface 3212 is slidable against the thrust surface 212, which is the thrust plate 216 according to Embodiment 1. The second scroll body 322 projects from a one-end surface 3211 of the second base plate 321 to form a scroll-shaped wall. A distal end of the second scroll body 322 faces the one end portion U, A sealing part that suppresses leakage of the refrigerant is provided at the distal end part of each of the first scroll body 312 of the fixed scroll 31 and the second scroll body 322 of the orbiting scroll 32. The cylindrical part 323 is a cylindrical boss that projects from the center or the proximity of the center of the other-end surface 3212 of the second base plate 321 toward the other end portion L. The second Oldham grooves 324 each have a rectangular shape and are formed in the other-end surface 3212 of the second base plate 321. A pair of the second Oldham grooves 324 are provided so as to be arranged on a substantially straight line with the axis of the crank shaft 6 interposed therebetween.

Furthermore, an Oldham ring 33 is provided in the Oldham disposing part 214 of the main frame 2. The Oldham ring 33 includes a ring part 331, first projections 332, and second projections 333. The ring part 331 has a ring shape and is disposed in a space formed between the main frame 2 and the second base plate 321 of the orbiting scroll 32. A pair of the first projections 332 facing each other are formed on a surface of the ring part 331 close to the other end portion L. A pair of the second projections 333 are formed on a surface of the ring part 331 close to the one end portion U and face each other. The pair of first projections 332 are accommodated in the pair of first Oldham grooves 215 of the main frame 2. The pair of second projections 333 are accommodated in the pair of second Oldham grooves 324 of the orbiting scroll 32. Thus, when the orbiting scroll 32 orbits due to rotation of the crank shaft 6, the Oldham ring 33 prevents the orbiting scroll 32 from rotating about its own axis.

A compression space 34 is formed by engaging the first scroll body 312 of the fixed scroll 31 and the second scroll body 322 of the orbiting scroll 32 with each other. The compression space 34 includes a plurality of sub-compression spaces. The volumes of the sub-compression spaces reduce from the radially outer side toward the radially inner side. The refrigerant is taken in from outer ends of the scroll bodies and the orbiting scroll 32 orbits. This gradually compresses the refrigerant. The compression space 34 communicates with a discharge port 313 that penetrates through a central part of the first base plate 311 of the fixed scroll 31. The compressed refrigerant is discharged through this discharge port 313. A discharge valve 35 and a muffler 36 are fixed to a surface of the fixed scroll 31 close to the one end portion U with, for example, screws. The discharge valve 35 opens and closes the discharge port 313 as specified to prevent backflow of the refrigerant. The muffler 36 has an discharge hole 361 and covers the discharge port 313 and the discharge valve 35.

The refrigerant is, for example, halogenated hydrocarbon having a double bond of carbon in the composition, halogenated hydrocarbon having no double bond of carbon in the composition, hydrocarbon, or a mixture containing these. Examples of the halogenated hydrocarbon having a double bond of carbon include an HFC refrigerant the ozone depletion potential of which is zero and tetrafluoropropene such as HFO1234yf, HFO1234ze, or HFO1243zf which is a fluorocarbon-based low GWP refrigerant and represented by a chemical formula C3H2F4. Examples of the halogenated hydrocarbon having no double bond of carbon include a refrigerant mixed with R32 (difluoromethane) represented as CH2F2, R41, or the like. Examples of the hydrocarbon include a natural refrigerant such as propane or propylene. Examples of the mixture include a mixed refrigerant in which HFO1234yf, HFO1234ze, HFO1243zf, or the like is mixed with R32, R41, or the like.

The drive mechanism unit 4 is provided at a portion closer to the other end portion L than the main frame 2 in the shell 1. The drive mechanism unit 4 includes a stator 41 and a rotor 42. The stator 41 has a ring shape and is formed by, for example, winding a wire around a core, which is formed by laminating a plurality of electromagnetic steel sheets, with an insulating layer interposed between the core and the wire. An outer circumferential surface of the stator 41 is fixedly supported at the inside of the main shell 11 by shrinkage fitting. The rotor 42 includes a permanent magnet disposed in a core formed by laminating a plurality of electromagnetic steel sheets. The rotor 42 has a cylindrical shape having a through hole that vertically penetrates through the rotor 42 at the center. The rotor 42 is disposed in an inner space of the stator 41.

The sub-frame 5 is a metal supporting part and provided at a portion closer to the other end portion L than the drive mechanism unit 4 in the shell 1. The sub-frame 5 is fixedly supported on an inner circumferential surface of a portion of the main shell 11 close to the other end portion L by shrinkage fitting, welding, or the like. The sub-frame 5 includes a sub-bearing part 51 and an oil pump 52. The sub-bearing part 51 is a ball bearing provided at an upper central part of the sub-frame 5. The sub-bearing part 51 has a hole that vertically penetrates therethrough at its center. The oil pump 52 is provided at a lower central part of the sub-frame 5. The oil pump 52 is disposed such that at least part of the oil pump 52 is immersed in the lubricant 9 stored in the lubricant storage 121 of the shell 1.

The crank shaft 6 is a rod-shaped long metal part and provided in the shell 1. The crank shaft 6 includes the main shaft part 61, an eccentric shaft part 62, and the lubricant channel 63. An outer surface of the main shaft part 61 is press-fitted into and fixed to the through hole of the rotor 42. The central axis of the main shaft part 61 is coincident with the central axis of the main shell 11. The eccentric shaft part 62 is provided at a portion closer to the one end portion U than the main shaft part 61 such that the central axis of the eccentric shaft part 62 is decentered from the central axis of the main shaft part 61. The lubricant channel 63 vertically penetrates through the main shaft part 61 and the eccentric shaft part 62. The eccentric shaft part 62 of the crank shaft 6 close to the one end portion U is inserted into and fixed to the cylinder of the cylindrical part 323. A portion of the crank shaft 6 close to the other end portion L is inserted into and fixed to the sub-bearing part 51 of the sub-frame 5. Thus, the main shaft part 61 of the crank shaft 6 is positioned in the main bearing part 22 of the main frame 2, and an outer surface of the rotor 42 is disposed in the stator 41 with a specified gap maintained between the outer surface of the rotor 42 and an inner surface of the stator 41.

The bushing 7 connects the orbiting scroll 32 and the crank shaft 6 to each other. According to Embodiment 1, the bushing 7 includes two parts, that is, a slider 71 and a balance weight 72. The slider 71 is a cylindrical part formed of, for example, metal such as iron. The slider 71 is fitted onto the eccentric shaft part 62 and fitted into the cylindrical part 323. The balance weight 72 is a ring-shaped part formed of, for example, metal such as iron. The balance weight 72 includes an annular part 721 and the weight part 722. The annular part 721 has a ring shape. An inner surface of the annular part 721 is engaged with an outer surface of a flange of the slider 71 by a method such as shrinkage fitting. As illustrated in FIG. 2, the weight part 722 is a weight having a substantially C shape when seen from the one end portion U. The weight part 722 is formed on a surface of the annular part 721 close to the one end portion U. The weight part 722 is disposed at a portion further to the outside than the cylindrical part 323, specifically, disposed in a portion of the accommodating space 211 defined by the main frame 2, the second base plate 321, and the cylindrical part 323, that is, a space to serve as a so-called intra-frame lubricant storage.

The power feed unit 8 feeds power to the scroll compressor and is provided on an outer circumferential surface of the main shell 11 of the shell 1. The power feed unit 8 includes a cover 81, a power feed terminal 82, and wiring 83. The cover 81 has a bottom and an opening. The power feed terminal 82 includes a metal part. One side of the power feed terminal 82 is provided inside the cover 81 and the other side of the power feed terminal 82 is provided in the shell 1. The wiring 83 is connected to the power feed terminal 82 at one end and connected to the stator 41 at the other end.

Figure 3:
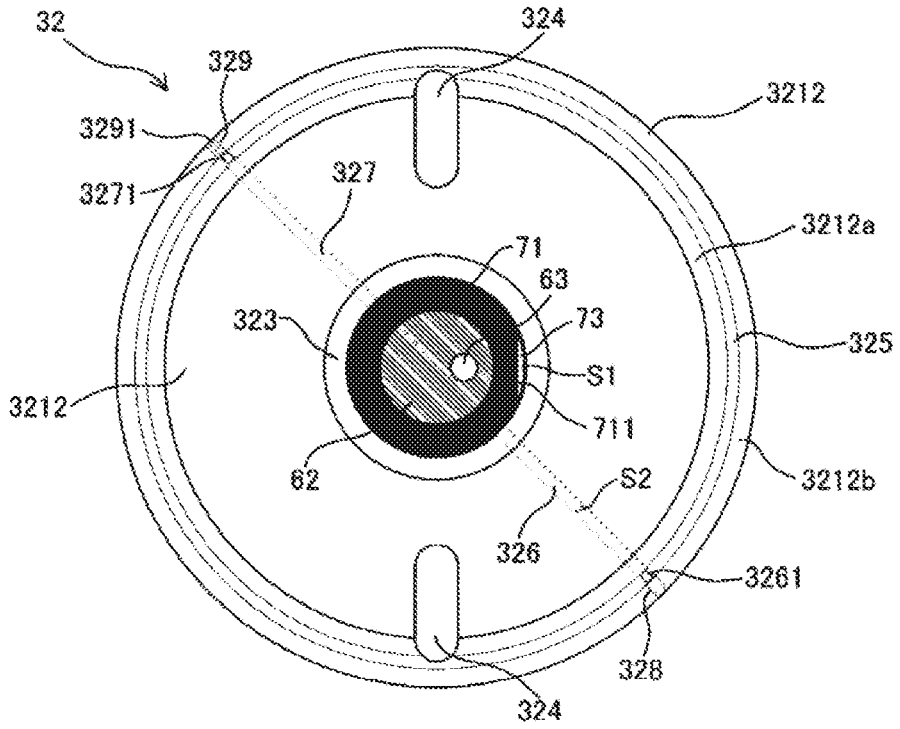
FIG. 3 illustrates the orbiting scroll when seen from an other end portion L.

Next, further details of the structure of the orbiting scroll 32 are described with reference to FIG. 3. FIG. 3 illustrates the orbiting scroll 32 when seen from the other end portion L. The eccentric shaft part 62 of the crank shaft 6 and the slider 71 of the bushing 7 disposed in the cylindrical part 323 of the orbiting scroll 32 are sectioned.

As can be seen from FIG. 3, the orbiting scroll 32 further includes a lubricant channel groove 325, a first inner channel 326, and a second inner channel 327. The lubricant channel groove 325 is an annular groove formed in an outer circumferential region of the other-end surface 3212 of the second base plate 321. Parts of the lubricant channel groove 325 are spatially continuous with the pair of second Oldham grooves 324. A first sliding surface 3212*a* is formed at a portion further to the inside than the lubricant channel groove 325 and a second sliding surface 3212*b* is formed at a portion further to the outside than the lubricant channel groove 325. That is, the lubricant channel groove 325 is interposed between the first sliding surface 3212*a* and the second sliding surface 3212*b*. An outer circumferential portion of the first sliding surface 3212*a* and an inner circumferential portion of the lubricant channel groove 325 are continuously connected to each other, and an outer circumferential portion of the lubricant channel groove 325 and an inner circumferential portion of the second sliding surface 3212*b* are continuously connected to each other. Preferably, the width of the second sliding surface 3212*b* is smaller than the width of the first sliding surface 3212*a*. Here, "sliding surface" means a surface to slide against the thrust bearing while the orbiting scroll is shaking. Thus, the sliding surface is not determined only within the orbiting scroll 32. The sliding surface is determined with respect to the thrust bearing.

The first inner channel 326 is connected to the inside of the cylindrical part 323 at one end and connected to the lubricant channel groove 325 at the other end. The second inner channel 327 has the similar structure to the structure of the first inner channel 326. The second inner channel 327 is provided in a portion facing the first inner channel 326 with the axis of the crank shaft 6 interposed therebetween. The first inner channel 326 and the center of the second base plate 321 are provided on a substantially straight line.

As illustrated in FIG. 3, a flat surface 711 is formed on an outer wall surface of the slider 71. A lubricant flowing space 73 is formed by the flat surface 711 of the bushing 7 and an inner wall surface of the cylindrical part 323. When the sectional area of the lubricant flowing space 73 is S1 and the sectional area of the first inner channel 326 is S2, S1>S2 is satisfied. When the lubricant 9 flows, resistance is smaller in the lubricant flowing space 73 than in the first inner channel 326. Thus, when the amount of the lubricant 9 flowing through the lubricant flowing space 73 is M1 and the amount of the lubricant 9 flowing through the first inner channel 326 is M2, M1>M2 can be established. Accordingly, the amount of the lubricant 9 supplied to a portion where friction is produced between the main bearing part 22 and the crank shaft 6 is larger than the amount of the lubricant 9 supplied to a portion where the orbiting scroll 32 and the thrust bearing slide against each other. Furthermore, when the relationships $0.05<M2/(M1+M2)<0.3$ are satisfied, an appropriate balance between the amount of the lubricant 9 supplied to the portion where friction is produced between the main bearing part 22 and the crank shaft 6 and the amount of the lubricant 9 supplied to the portion where the orbiting scroll 32 and the thrust bearing slide against each other can be obtained. The amount M1 of the lubricant 9 flowing through the lubricant flowing space 73 and the amount M2 of the lubricant 9 flowing through the first inner channel 326 can be adjusted by the sectional area S1 of the lubricant flowing space 73 or the sectional area S2 of the first inner channel 326 or by, for example, providing resistance in the channel. The relationships between the second inner channel 327 and the lubricant flowing space 73 are similar to the relationships between the first inner channel 326 and the lubricant flowing space 73.

Figure 4:
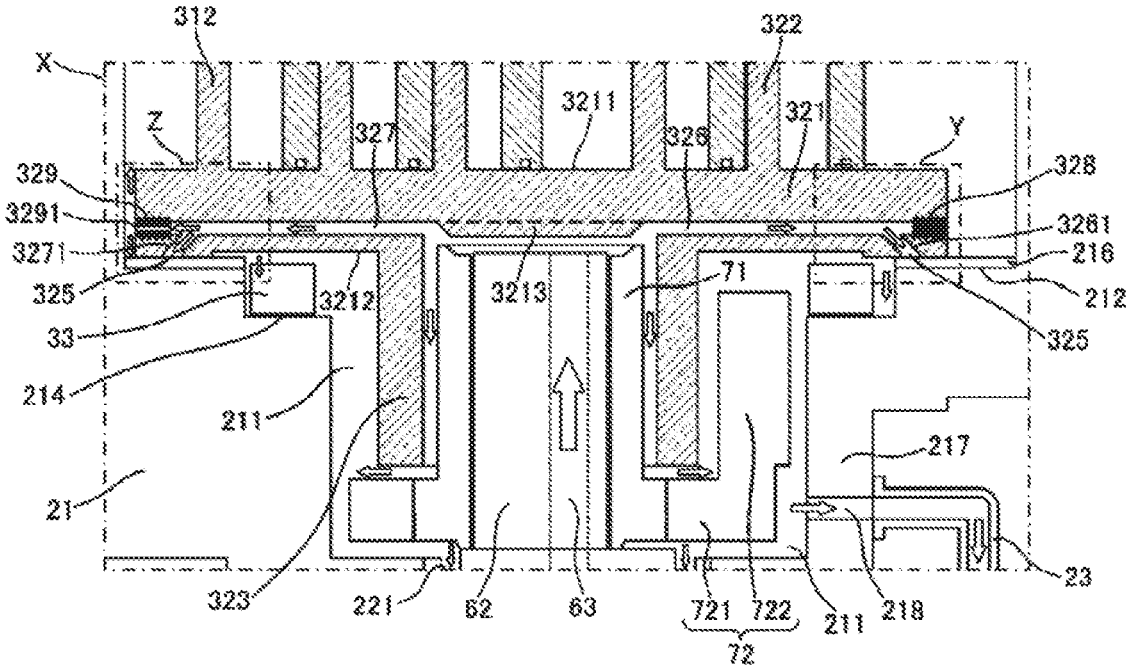
FIG. 4 is an enlarged view of a region surrounded by a dotted chain line X illustrated in FIG. 1.
Figure 5:
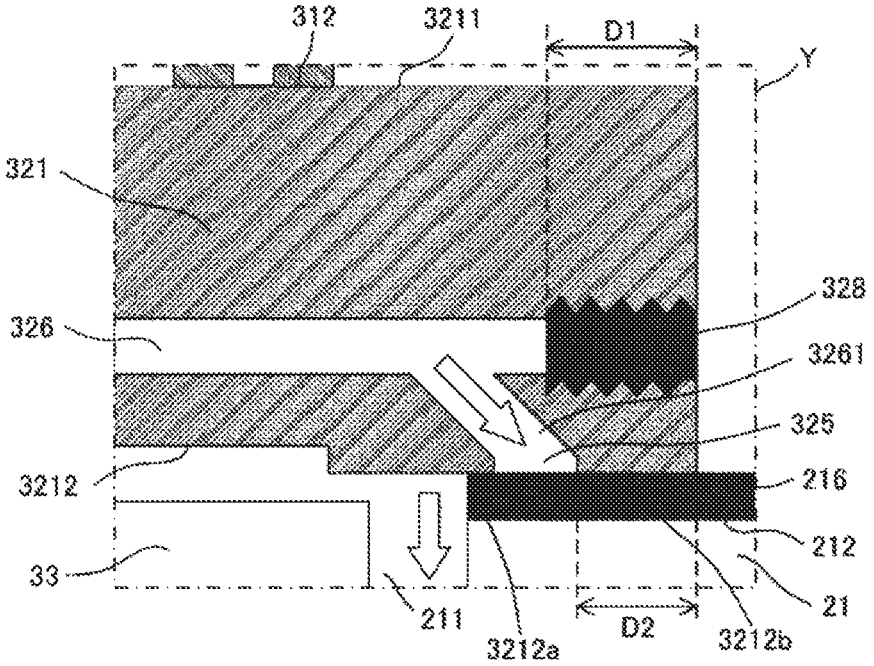
FIG. 5 is an enlarged view of a region surrounded by a dotted chain line Y illustrated in FIG. 4.
Figure 6:
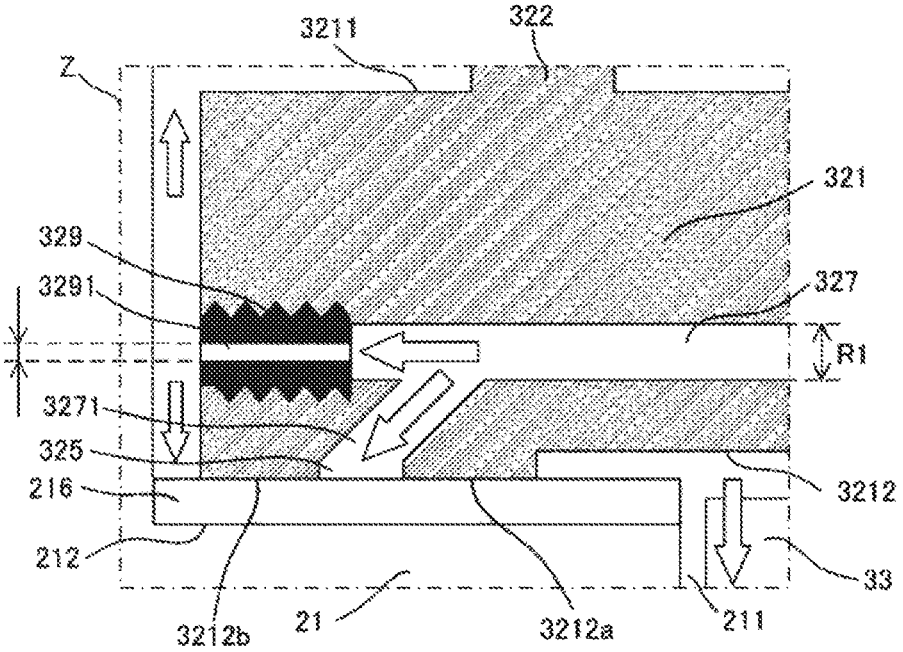
FIG. 6 is an enlarged view of a region surrounded by a dotted chain line Z illustrated in FIG. 4.

Further details of the first inner channel 326, the second inner channel 327, and so forth are described with reference to FIGS. 4 to 6. FIG. 4 is an enlarged view of a region surrounded by a dotted chain line X illustrated in FIG. 1. FIG. 5 is an enlarged view of a region surrounded by a dotted chain line Y illustrated in FIG. 4. FIG. 6 is an enlarged view of a region surrounded by a dotted chain line Z illustrated in FIG. 4.

As illustrated in FIG. 4, the first inner channel 326 and the second inner channel 327 are formed along the other-end surface 3212 of the second base plate 321. The state expressed as "along the other-end surface 3212" is optimum when the first inner channel 326 and the second inner channel 327 are parallel to the other-end surface 3212. However, a state in which the first inner channel 326 and the second inner channel 327 are inclined relative to the other-end surface 3212 by ±about 10 degrees is tolerable. A frusto-conical thickness part 3213, the diameter of which gradually reduces toward the other end portion L, is formed at inner ends of the first inner channel 326 and the second inner channel 327 inside the cylindrical part 323, that is, around the center of the other-end surface 3212 of the second base plate 321. The thickness part 3213 produces an effect of ensuring the strength of a central part of the second base plate 321 to be subjected to a pressure increased by compression of the refrigerant. The thickness part 3213 also produces an effect of smoothly introducing the lubricant 9 sucked by the crank shaft 6 to the first inner channel 326 and the second inner channel 327 along an inclined surface of the thickness part 3213. A first plug part 328 and a second plug part 329 are respectively inserted into an outer end of the first inner channel 326 and an outer end of the second inner channel 327 from side portions. The first plug part 328 and the second plug part 329 are, for example, metal screws each formed of a material the linear expansion coefficient of which is close to the linear expansion coefficients of the fixed scroll 31 and the orbiting scroll 32. The first plug part 328 and the second plug part 329 are respectively inserted into and fixed to the first inner channel 326 and the second inner channel 327 by being screwed into respective thread grooves formed in the first inner channel 326 and the second inner channel 327. The first plug part 328 and the second plug part 329 close respective outer end portions of the first inner channel 326 and the second inner channel 327. As illustrated in FIG. 6, out of these plug parts, the second plug part 329 has a through hole 3291 at the center. The through hole 3291 penetrates through the second plug part 329 in the inside-outside direction. The second plug part 329 functions as an adjustment part with which a discharge amount of the lubricant 9 at the outer end portion of the second inner channel 327 (side of the second base plate 321) is adjusted. The details of the adjustment part will be described later.

The first inner channel 326 is a lateral hole most of the length of which is formed along the other-end surface 3212. Accordingly, the first inner channel 326 is connected to the lubricant channel groove 325 near the outer end thereof through a first connection hole 3261. The first connection hole 3261 is formed in the second base plate 321 so as to be inclined relative to the other-end surface 3212 of the second base plate 321. Specifically, the first connection hole 3261 extends from the proximity of a distal end of the first plug part 328 of the first inner channel 326 toward a portion that is close to the other end portion L and close to the outside to be connected to the lubricant channel groove 325. As illustrated in FIG. 5, when the length by which the first plug part 328 is inserted from the outer side of the second base plate 321 is D1 and a minimum distance between the outer side of the second base plate 321 and the first connection hole 3261 is D2, D1>D2 is satisfied. That is, the first connection hole 3261 is formed through a portion of the second base plate 321 that is closer to the other end portion L than the first plug part 328. Thus, the lubricant channel groove 325 can be formed at a position closer to the outer end. Accordingly, when the orbiting scroll 32 is disposed in the main frame 2, the lubricant channel groove 325 easily faces the thrust surface 212 (thrust plate 216). Thus, the lubricant 9 can be effectively supplied to the thrust plate 216. The widths of the first sliding surface 3212*a* and the second sliding surface 3212*b* can also be adjusted. Furthermore, since the first connection hole 3261 is inclined, the lubricant 9 flowing through the first inner channel 326 can smoothly flow into the lubricant channel groove 325. Also, the second inner channel 327 is connected to the lubricant channel groove 325 through a second connection hole 3271. The structure of the second connection hole 3271 is similar to the structure of the first connection hole 3261.

An example of a method of forming the first inner channel 326 and so forth is described. First, the lubricant channel groove 325 is formed in an outer circumferential region of the other-end surface 3212 of the second base plate. Next, a hole is formed from the side of the second base plate 321 to an inner space of the cylindrical part 323 along the other-end surface 3212 by, for example, a drill. Thereby, the first inner channel 326 is formed. Then, a hole is formed by, for example, a drill in an inclined direction from the lubricant channel groove 325 toward a portion that is close to the one end portion U and close to the center of the second base plate 321, thereby the first connection hole 3261 connected to the first inner channel 326 is formed. At last, a thread groove is formed in a circumferential surface of the first inner channel 326 to a specified distance from the side of the second base plate 321. With this method, the first inner channel 326 and so forth can be easily formed. The second inner channel 327 is formed in a similar method.

Next, operation of the scroll compressor is described. When the power is supplied to the power feed terminal 82 of the power feed unit 8, torque is produced in the stator 41 and the rotor 42, thereby the crank shaft 6 is rotated. The rotation of the crank shaft 6 is transmitted to the orbiting scroll 32 through the eccentric shaft part 62 and the bushing 7. The rotation of the orbiting scroll 32 about its own axis is suppressed by the Oldham ring 33, and the orbiting scroll 32 orbits in a decentered manner. In so doing, the first sliding surface 3212*a* and the second sliding surface 3212*b* slide against the thrust plate 216. Accordingly, the lubricant channel groove 325 provided between the first sliding surface 3212*a* and the second sliding surface 3212*b* of the other-end surface 3212 of the orbiting scroll 32 does not protrude from the thrust plate 216 being the thrust bearing. That is, the lubricant channel groove 325 is in such a positional relationship with the thrust plate 216 that the lubricant channel groove 325 faces the thrust plate 216.

Meanwhile, the refrigerant sucked into the shell 1 through the suction pipe 111 enters the compression space 34 through the refrigerant channel 213 of the main frame 2. Then, along with the decentered orbiting of the orbiting scroll 32, the refrigerant is reduced in volume and compressed while being moved from an outer circumferential part toward the center. The orbiting scroll 32 in the decentered orbiting is moved together with the bushing 7 in the radial direction due to the centrifugal force of the orbiting scroll 32, thereby the second scroll body 322 and the first scroll body 312 are brought into close contact with each other. This prevents leakage of the refrigerant from the high-pressure side to the lower-pressure side in the compression space 34. Thus, the compression is performed with high efficiency. The compressed refrigerant is discharged through the discharge port 313 of the fixed scroll 31 resisting the discharge valve 35 and discharged from the shell 1 through the discharge hole 361 of the muffler 36 and the discharge pipe 131.

Here, when the orbiting scroll 32 shakes due to the rotation of the crank shaft 6, the lubricant 9 stored in the lubricant storage 121 of the shell 1 is sucked by the oil pump 52. The lubricant 9 passes through the lubricant channel 63 of the crank shaft 6, and in a space between a distal end of the eccentric shaft part 62 and the orbiting scroll 32, that is, in a so-called lubricant lift storage, as illustrated in FIG. 4, this flow of the lubricant 9 is split into a flow flowing through a space between the cylindrical part 323 of the orbiting scroll 32 and the slider 71, a flow flowing through the first inner channel 326, and a flow flowing through the second inner channel 327. The flow of the lubricant 9 flowing through the space between the cylindrical part 323 of the orbiting scroll 32 and the slider 71, in particular, flowing through the lubricant flowing space 73 is further split into a flow flowing through a portion close to the main bearing part 22 of the main frame 2 and a flow flowing through a portion close to the intra-frame lubricant storage. The lubricant 9 flowing through the portion close to the main bearing part 22 of the main frame 2 lubricates the portion where friction is produced between the main bearing part 22 and the crank shaft 6. The lubricant 9 flowing through the intra-frame lubricant storage is, as illustrated in FIG. 4, returned to the lubricant storage 121 of the shell 1 through the lubricant discharge hole 218 of the wall part 217 of the main frame 2 facing the weight part 722 of the bushing 7 and, by utilizing the self weight, through the lubricant return pipe 23.

The lubricant 9 flowing through the first inner channel 326 is supplied to the lubricant channel groove 325 through the first connection hole 3261. Then, the lubricant 9 flows through the lubricant channel groove 325 while being guided by the wall inside the lubricant channel groove 325 and entirely lubricates a region between the outer circumferential region of the other-end surface 3212 of the second base plate 321 and the thrust plate 216. After the region between the second base plate 321 and the thrust plate 216 has been evenly lubricated, the excessive lubricant 9 drops into the intra-frame lubricant storage through the second Oldham grooves 324 and the surface of the thrust plate 216, and then, is returned to the lubricant storage 121 through the lubricant discharge hole 218 and the lubricant return pipe 23.

As illustrated in FIG. 6, the lubricant 9 flowing through the second inner channel 327 flows in the direction of the second connection hole 3271 and, part of the lubricant 9 flowing through the second inner channel 327 flows in the direction of the second plug part 329. As is the case with the lubricant 9 flowing through the first inner channel 326, the lubricant 9 flowing in the direction of the second connection hole 3271 flows into the lubricant channel groove 325 and lubricates the other-end surface 3212 of the second base plate 321 and the thrust plate 216. The flow amount of the lubricant 9 having flowed to the second plug part 329 is adjusted by the through hole 3291. Then, the lubricant 9 is discharged through the side of the second base plate 321. The amount of the lubricant 9 discharged through the second plug part 329 can be adjusted also by the viscosity. The flow of the lubricant 9 having discharged through the side of the second base plate 321 is further split into a flow flowing toward the thrust plate 216 and a flow lifted toward the one-end surface 3211 of the second base plate 321, that is, subjected to so-called lubricant lift. The lubricant 9 having flowed toward the thrust plate 216 lubricates the region between the other-end surface 3212 of the second base plate 321 and the thrust plate 216. The lubricant 9 lifted toward the fixed scroll 31 enters the compression space 34, thereby lubricating a portion where the fixed scroll 31 and the orbiting scroll 32 slide against each other and functioning as a seal that prevents leakage of the refrigerant through the gaps between the scroll bodies and the base plates. However, when the lifting amount of the lubricant 9 is excessively large, the lubricant 9 is moved to a heat exchanger through the discharge pipe 131 of the shell 1 and stored there. This causes reduction of heat exchange efficiency. In contrast, when the amount of the lubricant is excessively small, the amount of the lubricant 9 supplied to the region where the fixed scroll 31 and the orbiting scroll 32 slide against each other is reduced. This causes insufficient lubrication and insufficient sealing. Accordingly, it is preferable that the discharge amount of the lubricant 9 through the second plug part 329 be adjusted to lift an appropriate amount of the lubricant 9. For example, the area of the channel of the through hole 3291 for the lubricant 9 is set to be smaller than the area of the channel of the second inner channel 327. Furthermore, when the diameter of the hole of the second inner channel 327 is R1 and the diameter of the hole of the through hole 3291 is R2, the following relationships are satisfied: R2/R1 is from 30 to 50%.

Figure 7:
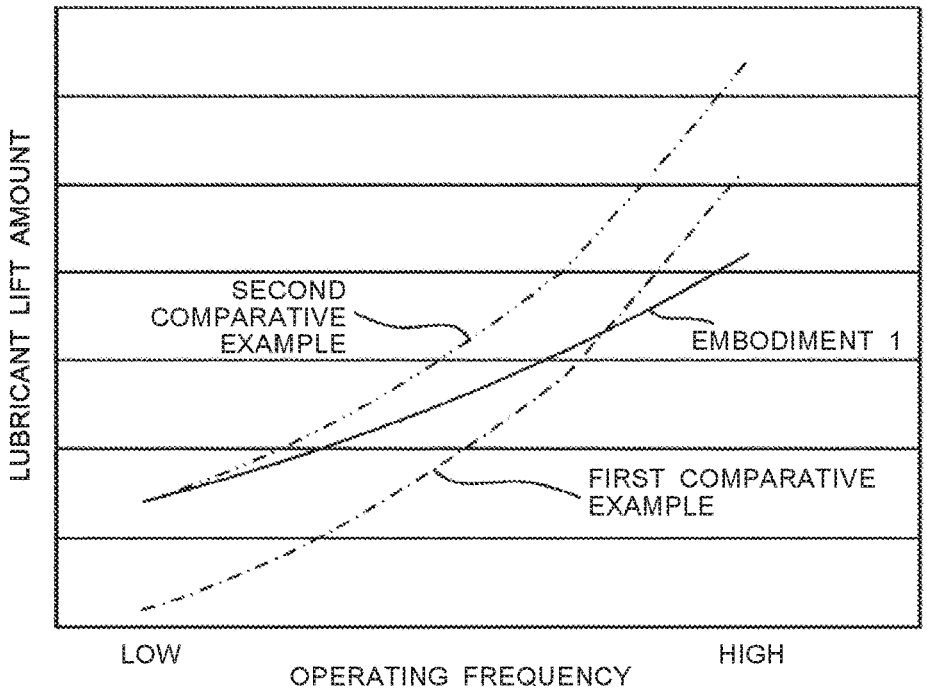
FIG. 7 explains lubricant lift according to Embodiment 1 and comparative examples.

Next, the lubricant lift according to Embodiment 1 in accordance with variation of an operating frequency (rotation speed of the crank shaft) of the compressor is described with reference to FIG. 7. FIG. 7 explains the lubricant lift according to Embodiment 1 and comparative examples. A first comparative example is a compressor in which, as is the case with Patent Literature 1, the intra-frame lubricant storage is filled with the lubricant 9 and the lubricant 9 is lifted by an overflow caused by a lubricant pressure.

As can be seen from FIG. 7, according to Embodiment 1 and the first and second comparative examples, as the operating frequency increases, the amount of the lubricant lift increases. However, variation of the lubricant lift amount between high-speed operation and low-speed operation is smaller with Embodiment 1 than with the first or second comparative example. That is, according to Embodiment 1, the lubricant lift amount is stable even when the operating frequency varies. In contrast, according to the first comparative example, although an appropriate lubricant lift amount can be obtained at middle to high operating frequencies, the lubricant lift amount is excessively small at low frequencies. When the lubricant lift amount is excessively small, insufficient lubrication or insufficient sealing for the fixed scroll 31 and the orbiting scroll 32 may be caused. According to the second comparative example, although an appropriate lubricant lift amount can be obtained at low to middle operating frequencies due to the increase in the total amount of the lubricant 9, the lubricant lift amount is excessive at high frequencies. When the lubricant lift amount is excessive, the lubricant 9 is moved to the heat exchanger through the discharge pipe 131 of the shell 1 and a refrigerant pipe and stored in the heat exchanger, and accordingly, the heat exchange efficiency is likely to reduce.

For a single rotation of the crank shaft, a specified amount of the lubricant is pumped up from the lubricant storage by the oil pump. Thus, the amount of the sucked up lubricant varies in accordance with the operating frequency. The amount of the sucked up lubricant reduces at low operating frequencies and increases at high operating frequencies. In a compressor that causes an overflow of the lubricant such as a compressor of the first or second comparative example, the amount of the lubricant supplied to the thrust bearing and the amount of the lubricant lifted and supplied to the compression space are determined in proportion to the amount of the lubricant stored in the intra-frame lubricant storage. Accordingly, when the amount of the lubricant supplied to the thrust bearing is set to be sufficient for low-speed operation, the lubricant lift is excessive during high-speed operation. When the lubricant lift amount is set to be appropriate for high-speed operation, the lubricant at the thrust bearing is insufficient during low-speed operation. Thus, it is difficult to supply an appropriate amount of the lubricant for both the high-speed operation and the low-speed operation.

In contrast, according to Embodiment 1, the flow amount of the lubricant 9 sucked up by the crank shaft 6 is adjusted by the second plug part 329 through the second inner channel 327, and then, this lubricant 9 is discharged from the side of the second base plate 321 of the orbiting scroll 32 and lifted. With this method, the amount of the lubricant 9 involved in the lubricant lift can be adjusted. Thus, variation of the lubricant lift amount can be reduced even when the operating frequency varies. Accordingly, compared to the overflow method, effects of the operating frequency are reduced, and an appropriate amount of the lubricant can be lifted in operation at low to high operating frequencies. Furthermore, since the lubricant 9 in the lubricant lift storage of the orbiting scroll 32 is directly lifted, time for the lubricant 9 to reach the compression space 34 can be reduced. Accordingly, even for a test run or a startup after a long-time stop, preferable sealing properties and preferable lubricating properties between the scrolls can be realized.

Furthermore, with the method of supplying lubricant to the thrust bearing according to Embodiment 1, it is not required that the intra-frame lubricant storage be filled with the lubricant 9. This allows use of the following structure: the lubricant discharge hole 218 is formed in the wall part 217 of the main frame 2 facing the weight part 722 of the bushing 7 to positively return the lubricant 9 in the intra-frame lubricant storage to the lubricant storage 121 of the lower shell 12 through the lubricant return pipe 23. When the amount of the lubricant 9 in the intra-frame lubricant storage is reduced, the occurrence of an agitation loss, that is, production of resistance in the weight part 722 and the Oldham ring 33 due to the lubricant 9 during the rotation of the crank shaft 6 can be suppressed. Conventionally, this agitation loss is typically reduced by increasing the distance between the weight part 722 and an inner wall of the main frame 2. With the present structure, such design is not required. Thus, the size and the weight can be reduced. When considering further reduction of the agitation loss of the weight part 722, it is preferable that the lubricant discharge hole 218 be formed below the weight part 722, that is, in the proximity of the wall part 217 facing the side of the annular part 721, so that almost no part of the weight part 722 is immersed in the lubricant 9. The agitation loss is significant during high-speed rotation of the crank shaft 6, during operation under the conditions that reduces the temperature of the lubricant 9, and during use of the lubricant 9 having high viscosity grade. However, the present structure is usable under such design and use conditions. In particular, nowadays, there exit demands for increasing the capacity of compressors for high-speed operation. Accordingly, the present structure significantly responds to the needs of the market.

Figure 8:
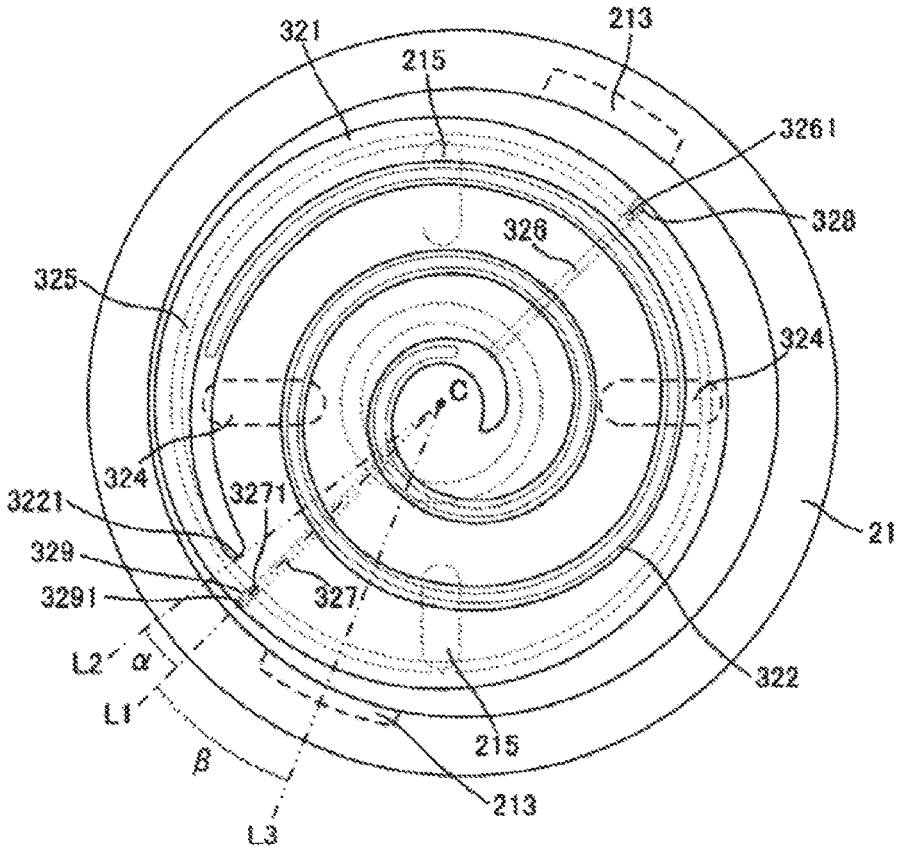
FIG. 8 illustrates the main frame and the orbiting scroll when seen from the one end portion.

The lubricant lift and whether the lubricant 9 enters the compression space 34 affect, for example, the positional relationship between the second plug part 329 and the second scroll body 322 of the orbiting scroll 32. Accordingly, the positional relationship of these is described with reference to FIG. 8. FIG. 8 illustrates the main frame and the orbiting scroll when seen from the one end portion.

As illustrated in FIG. 8, an angle α formed between a line L1 and a line L2 is set to be 10 degrees or smaller. Here, the line L1 connects the center of the hole of the second inner channel 327 formed in the side of the second base plate 321 of the orbiting scroll 32 and a center C of the second base plate 321 to each other. The line L2 connects an outermost end part 3221 of the second scroll body 322 and the center C of the second base plate 321 to each other. That is, the hole of the side of the second inner channel 327 is disposed in the proximity of the outermost end part 3221 of the second scroll body 322, that is, in the proximity of a so-called winding end. This facilitates entrance, through the winding end of the second scroll body 322, of the lubricant 9 having been discharged through the through hole 3291 of the second plug part 329 and lifted, and the lubricant 9 can be efficiently supplied to the compression space 34. Even in the case where the hole of the side of the second inner channel 327 is positioned closer to a winding start of the second scroll body 322 than the outermost end part 3221 of the second scroll body 322, the lifted lubricant 9 can be efficiently introduced into the compression space 34 as long as the angle α is 10 degrees or smaller. A similar effect can be obtained when the angle α formed between the line L1 and a line L2 is set to be 10 degrees or smaller. The line L1 connects the center of the hole of the second inner channel 327 formed in the side of the second base plate 321 of the orbiting scroll 32 and the center C of the second base plate 321 to each other. The line L2 in this case connects an outermost end part (winding end) of the first scroll body 312 of the fixed scroll 31 and the center C of the second base plate 321 to each other.

Furthermore, as illustrated in FIG. 8, an angle β formed between the line L1 and a line L3 is set to be 45 degrees or smaller. The line L1 connects the hole of the second inner channel 327 formed in the side of the second base plate 321 of the orbiting scroll 32 and the center C of the second base plate 321 to each other. The line L3 connects the refrigerant channel 213 of the main frame 2 and the center C of the second base plate 321 to each other. That is, the hole of the side of the second inner channel 327 is disposed in the proximity of the refrigerant channel 213, through which the refrigerant passes between the inside and the outside of the main frame 2. Thus, the lubricant 9 having been discharged through the through hole 3291 of the second plug part 329 is likely to be lifted together with the refrigerant, and the lubricant 9 can be efficiently supplied to the compression space 34. Since the orbiting scroll 32 shakes relative to the main frame 2, variation of timing causes the angle β to vary. Preferably, the above-described relationships are satisfied at any timing during the shaking. Furthermore, in the case of a low-pressure shell method in which the refrigerant is sucked through the refrigerant channel 213 of the main frame 2, compressed in the compression space 34, and discharged through the hole at the central part of the fixed scroll 31, the lubricant 9 can be lifted together with the refrigerant by using a suction pressure caused when the refrigerant passes through the refrigerant channel 213.

Figure 9:
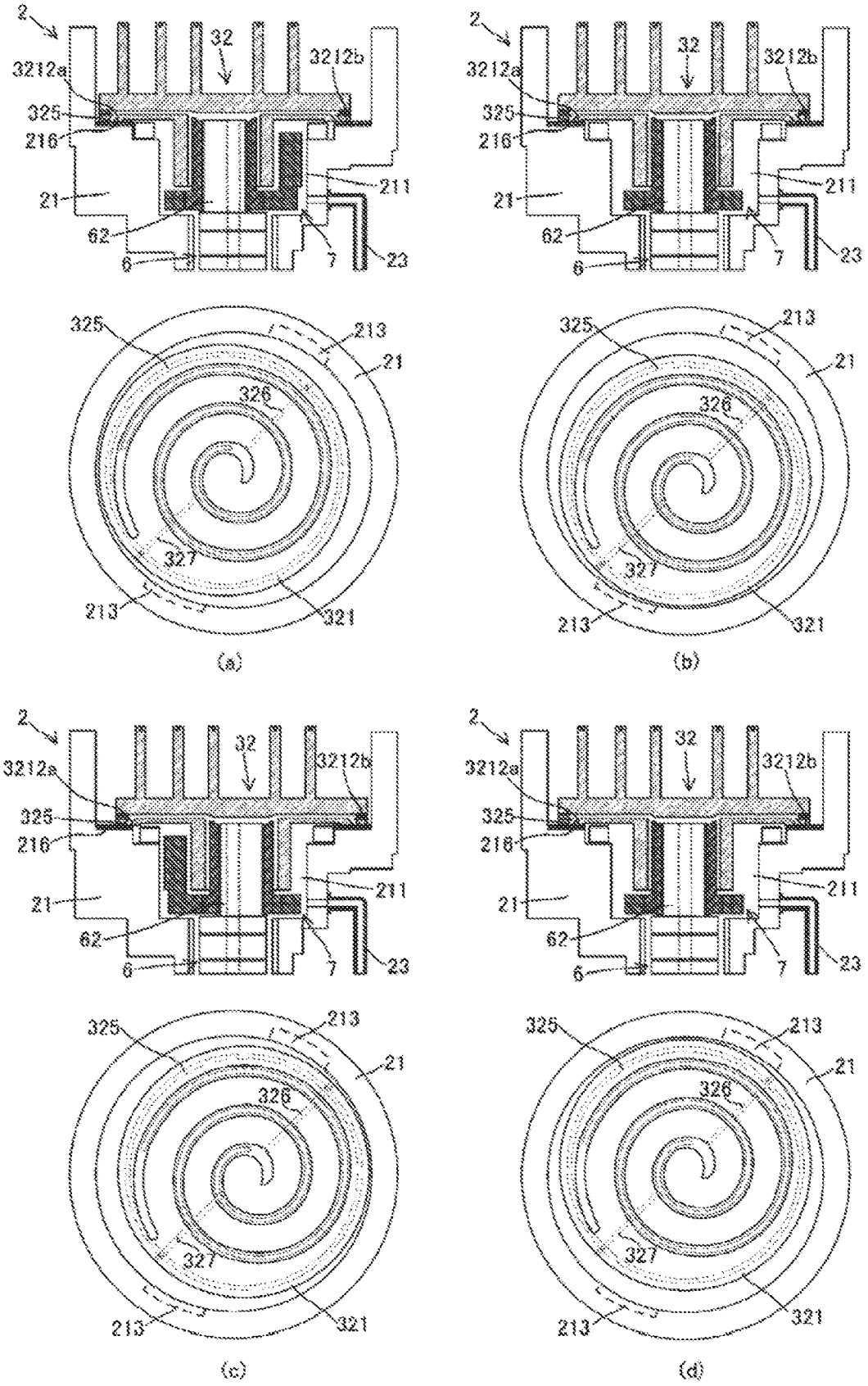
FIG. 9 includes views that explain shaking states of the orbiting scroll relative to the main frame, and out of views (a) to (d), view (a) illustrates a reference state, view (b) illustrates a state in which a crank shaft is rotated through ¼ of a turn from the reference state, view (c) illustrates a state in which the crank shaft is rotated through ½ of a turn from the reference state, and view (d) illustrates a state in which the crank shaft is rotated through ¾ of a turn from the reference state.

Next, further details of the relationship between the main frame 2 and the orbiting scroll 32 during the shaking are described with reference to FIG. 9. FIG. 9 includes views that explain shaking states of the orbiting scroll relative to the main frame. View (a) illustrates a reference state; view (b) illustrates a state in which the crank shaft is rotated through ¼ of a turn from the reference state, view (c) illustrates a state in which the crank shaft is rotated through ½ of a turn from the reference state; and view (d) illustrates a state in which the crank shaft is rotated through ¾ of a turn from the reference state.

View (a) of FIG. 9 illustrates the same state as the state illustrated in, for example, FIGS. 1 and 4. As described above; the lubricant channel groove 325 is not brought out of alignment from the thrust plate 216 and faces the thrust plate 216. As illustrated in view (b) of FIG. 9, when the crank shaft is rotated through ¼ of a turn from the reference state, the position of the orbiting scroll 32 is relatively shifted to the right with respect to the reference state in sectional view. Even in this state, the lubricant channel groove 325 is not brought out of alignment from the thrust plate 216 and faces the thrust plate 216. As illustrated in view (c) of FIG. 9, when the crank shaft is rotated through ½ of a turn from the reference state, the position of the orbiting scroll 32 is relatively shifted further to the right. Even in this state, the lubricant channel groove 325 is not brought out of alignment from the thrust plate 216 and faces the thrust plate 216. As illustrated in view (d) of FIG. 9, when the crank shaft is rotated through ¾ of a turn from the reference state, the position of the orbiting scroll 32 is returned to a state similar to the state illustrated in view (b) of FIG. 9. Even in this state, the lubricant channel groove 325 is not brought out of alignment from the thrust plate 216 and faces the thrust plate 216.

When the crank shaft 6 is rotated, the orbiting scroll 32 shakes, for example, counterclockwise relative to the main frame 2 seen from the one end portion U, and the states of views (a) to (b) to (c) to (d) . . . of FIG. 9 are repeated. Accordingly, even during the shaking of the orbiting scroll 32, the lubricant channel groove 325 is not brought out of alignment from the thrust plate 216 and constantly faces the thrust plate 216. When there is timing at which the lubricant channel groove 325 of the orbiting scroll 32 that is shaking protrudes from the thrust plate 216, the lubricant 9 leaks toward the intra-frame lubricant storage at this timing and the likelihood of insufficient lubrication being locally caused increases. However, according to Embodiment 1, since the lubricant 9 is constantly supplied to the thrust plate 216 through the lubricant channel groove 325, the entirety of the portion where the orbiting scroll 32 and the thrust plate 216 slide against each other can be stably lubricated. Furthermore, since the lubricant 9 in the lubricant lift storage of the orbiting scroll 32 is directly introduced to the thrust bearing, time for the lubricant 9 to reach the thrust bearing can be reduced. Accordingly, even for a test run or a startup after a long-time stop, seizure of the thrust bearing can be prevented.

In a refrigeration cycle apparatus that includes a compressor, a condenser, an expansion valve, and an evaporator, use of a refrigerant containing R32, which is a high-pressure refrigerant that is likely to increase in pressure, as the refrigerant increases a burden borne by the thrust bearing. However, according to Embodiment 1, the lubricant 9 is stably supplied to the thrust bearing. Thus, even when the above-described refrigerant is used, seizure or the like of the thrust bearing can be suppressed. Particularly in the low-pressure shell method, a thrust load exerted on the thrust bearing increases. Thus, the fact that the pressure of R32 is high becomes a problem. However, this problem is likely to be solved with Embodiment 1.

Alternatively, when a refrigerant containing HFO-1234yf, the density of which is low, is used as the refrigerant of a refrigeration cycle apparatus, lubricant lift along with suction of the refrigerant through the refrigerant channel 213 of the main frame 2 of the low-pressure shell method becomes difficult. However, according to Embodiment 1, control of lifting an appropriate amount of the lubricant is possible due to the function of adjusting the flow amount of the lubricant 9 by using the second plug part 329. Thus, even the refrigerant containing HFO-1234yf can be stably lifted.

According to Embodiment 1, a crank shaft, an orbiting scroll, and an adjustment part are provided. The crank shaft has a lubricant channel that allows lubricant to flow therethrough. The orbiting scroll is attached to the crank shaft and has at least one inner channel which allows the lubricant supplied thereto through the crank shaft to outwardly flow therethrough. The adjustment part is provided in the at least one inner channel of the orbiting scroll and adjusts a flow amount of the lubricant flowing through the at least one inner channel. Accordingly, even when the operating frequency is varied, the lubricant can be sufficiently supplied to a portion where the thrust bearing and the orbiting scroll slide against each other.

The adjustment part has a through hole having a smaller area of a channel than an area of a channel for the lubricant in the at least one inner channel. Furthermore, when a diameter of a hole of the at least one inner channel is R1 and a diameter of a hole of the through hole is R2, following relationships are satisfied: R2/R1 is from 30 to 50%. Thus, the discharge amount of the lubricant can be adjusted to lift an appropriate amount of the lubricant.

The orbiting scroll includes a discoidal base plate and a cylindrical part that projects from one surface of the base plate. The at least one inner channel is connected to an inside of the cylindrical part at one end and penetrates the base plate to an outer side of the base plate at an other end. Furthermore, the at least one inner channel includes a first inner channel and a second inner channel provided at an opposite side to the first inner channel with an axis of the crank shaft interposed therebetween. A plug part that suppresses a flow of the lubricant toward the side of the base plate is provided in the first inner channel. The adjustment part that adjusts a discharge amount of the lubricant to the side of the base plate is provided in the second inner channel. Furthermore, the inner channels are formed along the one surface of the base plate. The orbiting scroll further has a lubricant channel groove formed in the one surface of the base plate and connection holes that connect the inner channels and the lubricant channel groove to one another. Accordingly, in the first inner channel 326, the lubricant 9 flows to the lubricant channel groove 325 through the connection hole 3261, and, in the second inner channel 327, the lubricant 9 passes through the second plug part 329 to be discharged through the outer side of the second base plate 321. Thus, an appropriate lubricant lift amount can be maintained while the lubricant 9 can be stably sufficiently supplied to the thrust bearing.

A frame, a fixed scroll, and a bushing are further provided. The frame has a thrust surface which slides against the orbiting scroll. The fixed scroll forms, together with the orbiting scroll, a compression space. The bushing includes a weight part disposed in a space formed by the base plate of the orbiting scroll, the cylindrical part, and the frame. The bushing connects the orbiting scroll and the crank shaft to each other. An angle $\alpha$ formed between a line L1 that connects a hole of the at least one inner channel formed in a side of the base plate of the orbiting scroll and a center C of the base plate to each other and a line L2 that connects an outermost end part of a scroll body formed in the fixed scroll or the orbiting scroll and the center C of the base plate to each other is 10 degrees or smaller. This facilitates entrance of the lifted lubricant 9 through the outermost end part of the scroll body. Accordingly, preferable sealing properties and preferable sliding properties can be realized.

The frame has a refrigerant channel that allows a refrigerant to flow between an inside and an outside of the frame. An angle $\beta$ formed between the line L1 that connects the hole of the at least one inner channel formed in the side of the base plate of the orbiting scroll and the center C of the base plate to each other and a line L3 that connects the refrigerant channel and the center C of the base plate to each other is 45 degrees or smaller. This facilitates entrance of the lubricant 9 together with the refrigerant passing through the refrigerant channel through the outermost end part of the scroll body. Accordingly, preferable sealing properties and preferable sliding properties can be realized.

The frame has a lubricant discharge hole at a wall part thereof facing the bushing. This can suppress the occurrence of the agitation loss of the weight part 722 caused by storing the lubricant 9 in the space in the main frame 2 where the weight part 722 of the bushing 7 is disposed.

Even when a high-pressure refrigerant such as R32 is used in the refrigeration cycle apparatus, the lubricant 9 can be stably supplied to the thrust bearing. Thus, seizure or the like of the thrust bearing can be suppressed. Also, even when a refrigerant that is difficult to be lifted due to low density thereof such as HFO-1234yf is used in the refrigeration cycle apparatus, lubricant lift can be stably performed.

Embodiment 2

Figure 10:
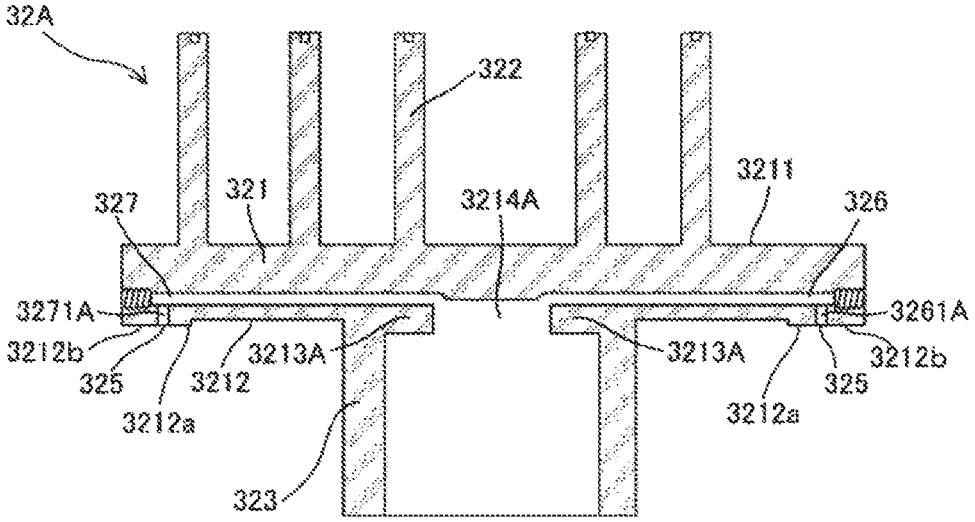
FIG. 10 is a sectional view of an orbiting scroll of the scroll compressor according to Embodiment 2 of the present invention.

FIG. 10 is a sectional view of the structure of an orbiting scroll of the scroll compressor according to Embodiment 2 of the present invention. In FIG. 10, parts having the same structures as those illustrated in FIGS. 1 to 9 are denoted by the same reference signs, thereby description thereof is omitted.

As illustrated in FIG. 10, an orbiting scroll 32A according to Embodiment 2 has a projection 3213A, which projects toward the center, at its portion close to the one end portion U in the cylindrical part 323. Thus, a lubricant storage space 3214A is formed at the center of a portion of the cylindrical part 323 close to the one end portion U. This lubricant storage space 3214A is resistive before the lubricant 9 sucked through the crank shaft 6 flows into the first inner channel 326 and the second inner channel 327. Thus, the flow amount of the lubricant 9 flowing through the first inner channel 326 and the second inner channel 327 can be adjusted. This configuration is particularly effective when it is desirable to limit the flow amount of the lubricant 9 flowing through the second inner channel 327, where the second plug part 329 as the adjustment part is provided.

Furthermore, a first connection hole 3261A and a second connection hole 3271A are vertical holes perpendicular to the other-end surface 3212. When the first connection hole 3261A and the second connection hole 3271A are vertical holes, these holes are easily produced compared to the case where these holes are inclined holes.

The present invention is not limited to the invention according to Embodiment 1 or Embodiment 2 having been described, and the present invention may be appropriately modified without departing from the gist of the present invention.

For example, although the scroll compressor according to Embodiment 1 or Embodiment 2 having been described is a vertical scroll compressor, the techniques herein can also be applied to a horizontal scroll compressor.

Although the scroll compressor according to Embodiment 1 or Embodiment 2 having been described is a low-pressure-shell scroll compressor, the techniques herein can also be applied to a high-pressure-shell scroll compressor. However, when considering the thrust load applied to the thrust surface 212 by the orbiting scroll 32, the auxiliary effect of the suction of the refrigerant through the refrigerant channel 213 of the main frame 2 in lifting the lubricant 9, and so forth, the present invention is more suitable to the low-pressure-shell scroll compressor.

The thrust plate 216 is not necessarily provided. Instead, the thrust surface 212 may slide against the orbiting scroll 32.

The first sliding surface 3212*a* and the second sliding surface 3212*b*, which are ring-shaped flat surfaces projecting from the other-end surface 3212 toward the other end portion L, may be flat surfaces at the same level as the level of the other-end surface 3212, that is, flush with the other-end surface 3212.

The lubricant channel groove 325 is not necessarily an annular groove. The lubricant channel groove 325 may be terminated by, for example, the second Oldham grooves 324 as long as the lubricant 9 can be sufficiently supplied to the entirety of the thrust bearing. The lubricant channel groove 325 does not necessarily have a ring shape, either.

Although at least one inner channel is required, three or more inner channels may be provided in accordance with the cases. For example, in addition to the pair of inner channels that are disposed on a substantially straight line with the crank shaft 6 interposed therebetween and supply lubricant 9 to the lubricant channel groove 325, an inner channel that includes the second plug part 329 and is used for lubricant lift may be provided. Furthermore, the sectional shape of the inner channels is not limited to a perfect-circular shape and may be, for example, an oval shape, an oblate circular shape, or a polygonal shape.

The second connection hole 3271 may be omitted when the lubricant 9 can be sufficiently supplied to the entirety of the thrust bearing by the first connection hole 3261 of the first inner channel 326 and the lubricant channel groove 325. In this case, the second inner channel 327 may instead be dedicated to adjustment of the flow amount of the lubricant 9 for lubricant lift. Thus, adjustment of the flow amount by the second plug part 329 can be facilitated.

The first plug part 328 and the second plug part 329 are not necessarily metal screws. That is, as long as the first plug part 328 and the second plug part 329 can be inserted into and fixed to the holes of the first inner channel 326 and the second inner channel 327, the first plug part 328 and the second plug part 329 may be metal pins to be connected by an adhesive or elastic parts such as rubber to be connected by being press-fitted.

The method of adjusting the flow amount of the lubricant 9 using the second plug part 329 is not limited to the through hole 3291. The method with which the adjustment is performed, for example, by utilizing the gap between the second base plate 321 and the second plug part 329 may be used.

The through hole 3291 does not necessarily extend along the other-end surface 3212. For example, the through hole 3291 may be inclined in a lubricant lifting direction (outward and toward the one end portion U) to facilitate lubricant lift. Furthermore, the diameter of the through hole 3291 may be varied.

REFERENCE SIGNS LIST

1 shell 11 main shell 111 suction pipe 12 lower shell 121 lubricant storage 122 fixing base 13 upper shell 131 discharge pipe 2 main frame 21 main body part 211 accommodating space 212 thrust surface 213 refrigerant channel 214 Oldham disposing part 215 first Oldham groove 216 thrust plate 217 wall part 218 lubricant discharge hole 22 main bearing part 221 shaft hole 23 lubricant return pipe 3 compression mechanism unit 31 fixed scroll 311 first base plate 312 first scroll body 313 discharge port 32 orbiting scroll 321 second base plate 3211 one-end surface 3212 other-end surface 3212*a* first sliding surface 3212*b* second sliding surface 322 second scroll body 3221 outermost end part 323 cylindrical part 324 second Oldham groove 325 lubricant channel groove 326 first inner channel 3261 first connection hole 327 second inner channel 3271 second connection hole 328 first plug part 329 second plug part 3291 through hole 33 Oldham ring 331 ring part 332 first projection 333 second projection 34 compression space 35 discharge valve 36 muffler 361 discharge hole 4 drive mechanism unit 41 stator 42 rotor 5 sub-frame 51 sub-bearing part 52 oil pump 6 crank shaft 61 main shaft part 62 eccentric shaft part 63 lubricant channel 7 bushing 71 slider 711 flat surface 72 balance weight 721 annular part 722 weight part 8 power feed unit 81 cover 82 power feed terminal 83 wiring 9 lubricant U one end portion L other end portion.

The invention claimed is:

1. A scroll compressor comprising:

a crank shaft having a lubricant channel which allows lubricant to flow therethrough;

an orbiting scroll attached to the crank shaft, the orbiting scroll including:

a discoidal base plate, a cylindrical part that projects from one surface of the base plate, inner channels foa reed along the one surface of the base plate configured to allow the lubricant supplied thereto through the crank shaft to outwardly flow therethrough, the inner channels including a first inner channel and a second inner channel, one end of the second inner channel is connected to an inside of the cylindrical part and another end of the second inner channel penetrates the base plate to a radial outer side of the base plate, a plug part is provided in the first inner channel and configured to suppress a flow of the lubricant toward the radial outer side of the base plate, an adjustment part provided in the second inner channel and configured to adjust a flow amount of the lubricant flowing through the second inner channel of the base plate, a lubricant channel groove is formed in the one surface of the base plate and connection holes that connect the inner channels and the lubricant channel groove to one another, wherein in the first inner channel the lubricant flows to the lubricant channel groove through a corresponding one of the connection holes, and in the second inner channel the lubricant passes through the adjustment part and is discharged out the radial outer side of the base plate.

2. The scroll compressor of claim 1, wherein the adjustment part has a through hole with a smaller cross-sectional area than a cross-sectional area of the second inner channel.

3. The scroll compressor of claim 2, wherein a diameter of the second inner channel is R1 and a diameter of the through hole of the adjustment part is R2 and R2/R1 is from 30 to 50%.

4. The scroll compressor of claim 1, further comprising;

a frame having a thrust surface which slides against the orbiting scroll;

a fixed scroll forming, together with the orbiting scroll, a compression space; and a bushing including a weight part provided outside the cylindrical part of the orbiting scroll and connecting the orbiting scroll and the crank shaft to each other.

5. The scroll compressor of claim 4, wherein an angle a formed between a line L1 that connects a hole of the second inner channel formed in a side of the base plate of the orbiting scroll and a center C of the base plate to each other and a line L2 that connects an outermost end part of a scroll body formed in the fixed scroll or the orbiting scroll and the center C of the base plate to each other is 10 degrees or smaller.

6. The scroll compressor of claim 4, wherein the frame has a refrigerant channel that allows a refrigerant to flow between an inside and an outside of the frame, and wherein an angle β formed between a line L1 that connects the hole of the second inner channel formed in the side of the base plate of the orbiting scroll and the center C of the base plate to each other and a line L3 that connects the refrigerant channel and the center C of the base plate to each other is 45 degrees or smaller.

7. The scroll compressor of claim 4, wherein the frame has a lubricant discharge hole at a wall part thereof facing the bushing.

8. A refrigeration cycle apparatus including the scroll compressor of claim 1, wherein refrigerant containing HFO-1234yf is used in the refrigeration cycle apparatus.

9. A refrigeration cycle apparatus including the scroll compressor of claim 1, wherein refrigerant containing R32 is used in the refrigeration cycle apparatus.

10. The scroll compressor of claim 1, wherein the second inner channel is provided at an opposite side to the first inner channel with a longitudinal axis of the crank shaft interposed therebetween.

11. A scroll compressor comprising a crank shaft having a lubricant channel which allows a lubricant to flow therethrough;

an orbiting scroll attached to the crank shaft, the orbiting scroll including:

a discoidal base plate, a cylindrical part that projects from one surface of the base plate, inner channels configured to allow the lubricant supplied thereto through the crank shaft to outwardly flow therethrough, the inner channels including a first inner channel and a second inner channel, one end of the second inner channel is connected to an inside of the cylindrical part and another end of the second inner channel penetrates the base plate to a radial outer side of the base plate, and an adjustment part is provided in the second inner channel and configured to adjust a flow amount of the lubricant flowing through the second inner channel;

a frame having a thrust surface which slides against the orbiting scroll;

a fixed scroll forming, together with the orbiting scroll, a compression space; and a bushing including a weight part provided outside the cylindrical part of the orbiting scroll and connecting the orbiting scroll and the crank shaft to each other, wherein an angle a formed between a line L1 that connects a hole of the second inner channel formed in a side of the base plate of the orbiting scroll and a center C of the base plate to each other and a line L2 that connects an outermost end part of a scroll body formed in the fixed scroll or the orbiting scroll and the center C of the base plate to each other is 10 degrees or smaller.

12. A scroll compressor comprising a crank shaft having a lubricant channel which allows a lubricant to flow therethrough;

an orbiting scroll attached to the crank shaft, the orbiting scroll including:

a discoidal base plate, a cylindrical part that projects from one surface of the base plate, inner channels configured to allow the lubricant supplied thereto through the crank shaft to outwardly flow therethrough, the inner channels including a first inner channel and a second inner channel, one end of the second inner channel is connected to an inside of the cylindrical part and another end of the second inner channel penetrates the base plate to a radial outer side of the base plate, and an adjustment part is provided in the second inner channel and configured to adjust a flow amount of the lubricant flowing through the second inner channel;

a frame having a thrust surface which slides against the orbiting scroll;

a fixed scroll forming, together with the orbiting scroll, a compression space; and a bushing including a weight part provided outside the cylindrical part of the orbiting scroll and connecting the orbiting scroll and the crank shaft to each other, wherein the frame has a lubricant discharge hole at a wall part thereof facing the bushing.

* * * * *